United States Patent [19]

Shiratori et al.

[11] 4,350,856

[45] Sep. 21, 1982

[54] RELAY FOR PRINTED CIRCUIT BOARD

[75] Inventors: Takahisa Shiratori; Masaru Tamura; Kouji Hanada, all of Suzaka, Japan

[73] Assignee: Fujitsu Limited, Kawasaki, Japan

[21] Appl. No.: 196,031

[22] Filed: Oct. 10, 1980

[30] Foreign Application Priority Data

Oct. 23, 1976 [JP] Japan ..... 51/146903

[51] Int. Cl.[3] ..... H01H 9/02

[52] U.S. Cl. ..... 200/306; 174/17 VA; 220/260; 335/199; 361/400

[58] Field of Search ..... 206/222; 220/284, 260, 220/89 A; 200/306, 302; 174/17 VA; 335/202, 199; 361/400

[56] References Cited

U.S. PATENT DOCUMENTS

| | | | |
|---|---|---|---|
| 2,225,791 | 12/1940 | Nau et al. | 200/306 |
| 2,440,462 | 4/1948 | Cooper | 220/89 A |
| 3,415,360 | 12/1968 | Baumann et al. | 206/222 |
| 3,970,068 | 7/1976 | Sato | 206/222 |
| 4,062,469 | 12/1977 | Rueb | 174/17 VA |

FOREIGN PATENT DOCUMENTS

| | | | |
|---|---|---|---|
| 2908887 | 9/1979 | Fed. Rep. of Germany | 335/202 |

*Primary Examiner*—John W. Shepperd
*Attorney, Agent, or Firm*—Staas & Halsey

[57] ABSTRACT

A relay for a printed circuit board, which can be dip-washed, comprising a relay cover which is mounted and sealed to a relay body, said relay cover being provided with a thin-walled portion which can be easily broken after dip-washing to define an opening in the cover.

10 Claims, 15 Drawing Figures

Fig. 9
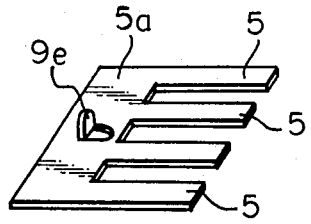
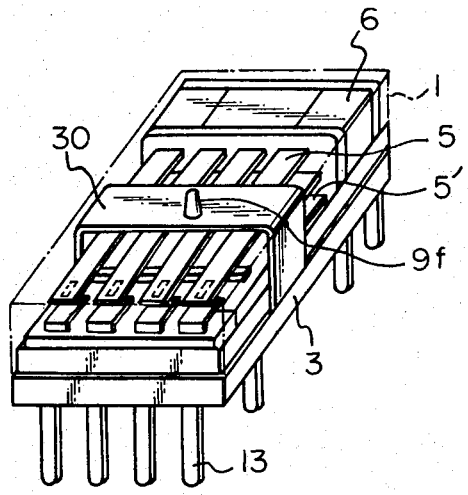
Fig. 10
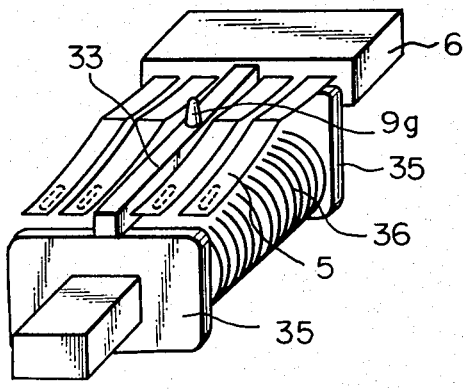
Fig. 11

RELAY FOR PRINTED CIRCUIT BOARD

FIELD OF THE INVENTION

This invention relates to a relay which is to be mounted on a printed circuit board.

BACKGROUND OF THE INVENTION

After a relay is mounted on an associated printed circuit board, which will be hereinafter referred to as pc board, terminals of the relay are electrically connected to the pc board, usually by means of soldering. After soldering, the pc board needs to be washed or cleaned to remove solder fluxes.

The washing is usually effected only on the soldered side of the pc board, and not on the other side on which is arranged the relay, so that only the soldered side of the pc board is put in a cleaning or washing liquid. This way of washing is rather difficult and troublesome, thus presenting an obstacle to an automatic washing operation.

However, if a so called "dip washing" method is used in which the pc board provided thereon with relays and/or another devices is entirely splashed or put in a washing liquid, the washing operation is simplified and automatic washing is possible.

However, in a conventionally known relay having a relay cover which is mounted on a base on which are arranged relay components, when the relay is entirely put in the washing liquid, the washing liquid can enter or penetrate into the relay where the base and the cover connect, since no special seal is effected between the base and the cover. The entrance or penetration of the washing liquid often results in faulty operation of the relay, such as failure to establish a complete electrical connection between contacts of the relay.

Alternatively, if the cover is completely sealed to the base of the relay to prevent the entrance or penetration of the washing liquid, any organic gas which may be produced inside the relay—for example, from a resin insulation of a relay coil or a resin coil bobbin when the coil is heated in operation—cannot escape from the relay and continues to stay therein. The organic gas also has an undesirable influence on the contacts of the relay.

As can be understood from the above discussion, in order to make "dip washing" possible, the relay not only must be completely sealed to prevent the washing liquid from penetrating or entering the relay when the latter is washed but also must be provided with an outlet or opening through which organic gas produced in the relay can escape during normal operation after the washing stage has been completed.

Japanese Utility Model Application No. 51-156977 (Laying Open Publication No. 53-74039) teaches one solution to this problem. In this prior application, the relay cover is provided with a closed hollow projection which can be cut after washing, so as to provide an opening for the organic gas to escape. According to this prior application, a relay is provided which can be "dip-washed" and from which interior organic gas can escape.

However, the provision of such a projection is not desirable, because, when the relays are packed, a bigger packaging box is necessary and the projections become obstacles when the relays are overlaid one on another. Furthermore, when the projections are cut, a cutting device is necessary and the cutting operations are troublesome.

SUMMARY OF THE INVENTION

The object of the present invention is to provide a relay which can be dip-washed and which is free from the drawbacks mentioned above.

The above-mentioned object can be achieved by a relay having a fluid tight cover provided with a thin walled portion which can be easily broken to provide an outlet for any gas which may acumulate in the relay during normal operation.

BRIEF DESCRIPTION OF THE DRAWINGS

The invention will be discussed below in detail, with reference to the drawings, in which:

FIG. 9 is a perspective view of a lead frame with a projection;

FIGS. 10 and 11 are partially cut away perspective views of different relays according to different modified embodiments of the present invention;

DETAILED DESCRIPTION OF THE PREFERRED EMBODIMENTS OF THE INVENTION

Figure 1:
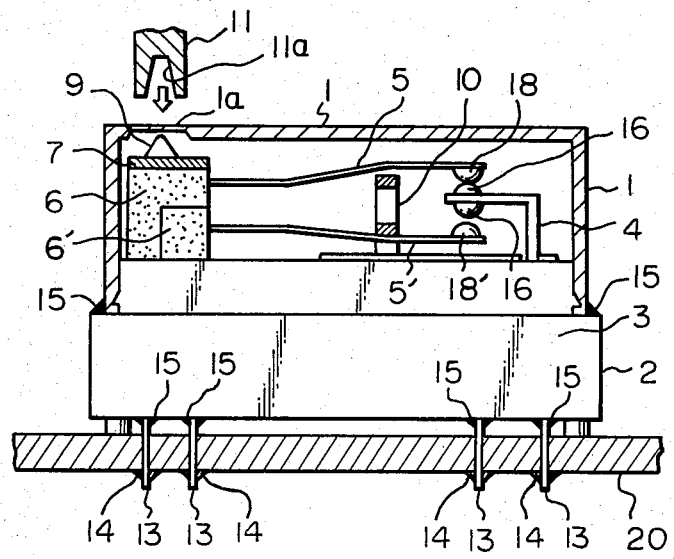
FIG. 1 is a partially sectioned elevational view of a relay mounted to a printed circuit board, according to the present invention.

In FIG. 1, the relay has a body 2 and a cover 1 which is mounted to the body 2. The relays are arranged on a pc board 20 and terminals 13 of the relay are electrically connected to the pc board 20. The body 2 includes a base 3 (FIG. 2) in which an electromagnetic device having relay elements, such as a coil, an iron core, a yoke, and an armature (all not shown) are arranged. On the base 3 is provided a fixed contact terminal 4 which is secured thereto and which has fixed contacts 16. Movable contact spring arms 5 and 5' having movable contacts 18 and 18' are supported by and connected to respective contact spring molds 6 and 6' which are provided on the base 3. The numeral 15 designates sealing adhesives between the cover 1 and the body 2, and between the body 2 and the terminals 13.

Figure 2:
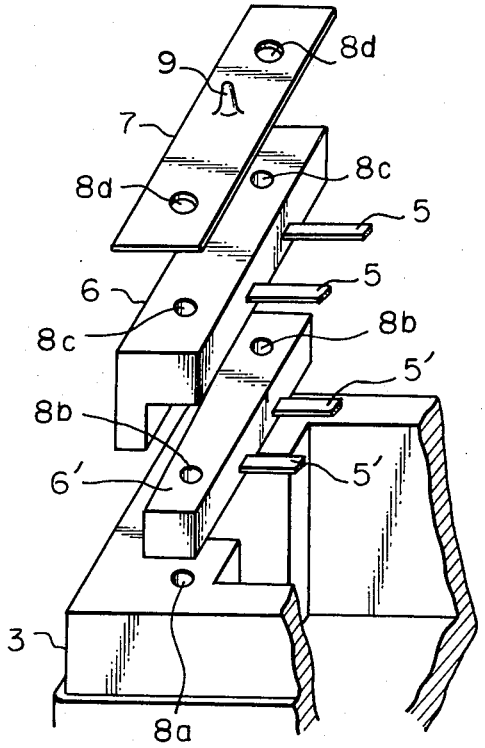
FIG. 2 is an exploded perspective view of a part of the relay illustrated in FIG. 1.

As can be seen from FIG. 2, the mold 6' is first located on the base 3, and then the mold 6 is located on the mold 6' in such a way that the threaded holes **8*a* formed in the base 3, the through holes 8*b* formed in the mold 6', and the through holes 8*c* formed in the mold 6 are aligned with one another. Finally, the molds 6 and 6'** are secured to the base 3 by means of a metal keep plate 7 which is located on the mold 6 and which has holes 8*d* through which set screws (not shown) are screwed in the corresponding threaded holes 8*a*.

As is well known, when the relay is energized, the spring arms 5 and 5' are moved up and down by means of a card 10 which is connected to the armature of the electromagnetic device (not shown) in the relay, so that a switching operation between the fixed contacts 16 and the movable contacts 18 and 18' can be performed.

In FIG. 1, the numeral 14 designates solder fluxes which are to be removed later.

According to the present invention, in order to make it possible to dip-wash the pc board with the relay or relays, the cover 1 is provided with a thin-walled portion 1*a* which is preferably of a circular shape, but not limited thereto, and which provides a mechanically weakened portion, so that the thin-walled portion 1*a* can be easily broken when a downward force is applied thereto.

Preferably, on the keep plate 7 is provided a projection 9 which is located below the thin-walled portion 1*a* and which contributes to an easier breakage or separation of the thin-walled portion 1*a*. When the thin-walled portion 1*a* is broken, a device 11 (FIG. 1) having a recess 11*a* complemental to the projection 9 can be used, so that the thin-walled portion 1*a* can be easily broken by the interaction of the device 11 and the projection 9.

Figure 3:
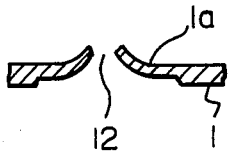
FIG. 3 is a schematic view of an opening which is formed by breaking a thin-walled portion of a relay cover.

As can be understood from the above discussion, according to the present invention, since the relay is completely sealed until the thin-walled portion 1*a* is broken, the pc board 20 with the relay can be entirely immersed in the washing liquid and can be dip-washed to remove the solder fluxes 14 (FIG. 1). After the completion of washing, the thin-walled portion 1*a* of the relay cover 1 is broken to provide an opening 12 (FIG. 3) through which the organic gas which is produced within the relay during operation can escape.

Figure 4:
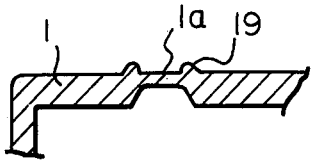
FIG. 4 is a sectional view of a modification of a thin-walled portion of a relay cover.

It is also possible to provide an annular ridge around the circular thin-walled portion 1*a*, as illustrated in FIG. 4. The modified cover shown in FIG. 4 has an advantage in that the thin-walled portion 1*a* can be easily determined.

Figure 5:
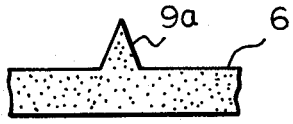
FIG. 5 shows a projection formed on a contact spring mold.

FIG. 5 shows a projection 9*a* which is provided on the mold 6, in place of on the keep plate 7 (FIG. 2). The modification shown in FIG. 5 can be preferably applied to a different type of relay which has no keep plate 7. In the case of a relay which includes the keep plate 7, it is necessary to provide an opening 7*a* (FIG. 6) on the keep plate 7 through which the projection 9*a* extends upwards.

Figure 6:
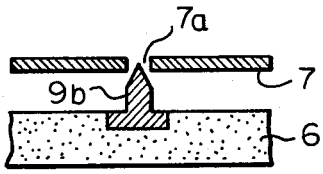
FIG. 6 shows a modification of FIG. 5.

FIG. 6 shows a metal projection 9*b* which is attached and secured to the mold 6.

Figure 7:
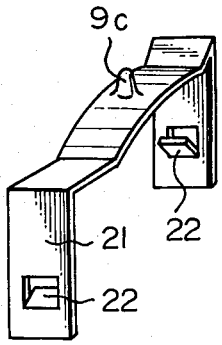
FIGS. 7 and 8 are perspective views of different metal bands which are used in place of a keep plate shown in FIG. 2.
Figure 8:
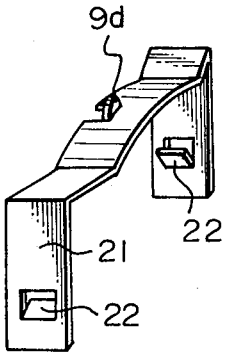
Figure 12:
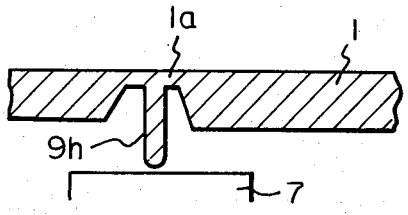
FIG. 12 shows a part of a cover which includes a thin-walled portion with a projection.
Figure 13:
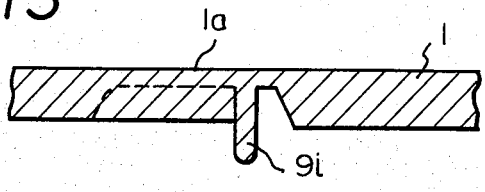
FIG. 13 shows a modification of FIG. 12.
Figure 14:
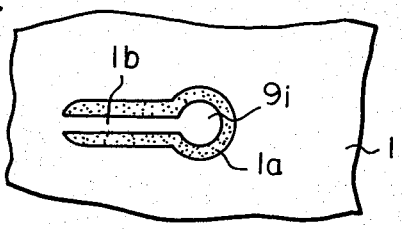
FIG. 14 is a plan view of a part of FIG. 13.

FIGS. 7 and 8 show a metal band 21 which is used in place of the keep plate 7 to secure the molds 6 and 6' on the base 3. The bands 21 shown in FIGS. 7 and 8 have projections 9*c* and 9*d*, respectively. The projection 9*d* can be obtained by cutting and bending the band 21. The band 21 can hold the molds 6, 6' together by engaging inwardly projecting tongues 22 in corresponding recesses (not shown) formed on the side faces of the base 3.

Alternatively, it is also possible to provide the projection 9*e* on the connecting strip 5*a* of spring arms 5, as shown in FIG. 9. The spring arms 5 are connected to each other by means of the connecting strip 5*a* in the mold 6. The plate illustrated in FIG. 9 is usually called a lead frame. In this embodiment, the projection 9*e* has to extend out of the mold 6.

A pin having a projection corresponding to for example, the projection 9*b* in FIG. 6, can be located between the two molds 6, 6' so as to project upward from the mold 6 (this modification is not illustrated in the drawing). Such a pin can be easily incorporated in the mold 6 when the mold 6 is formed.

When the thin-walled portion 1*a* is pushed down, it is slightly flexed downward so that the projection 9 (or 9*a*, 9*b*, 9*c*, 9*d* or 9*e*) is thrust into the thin-walled portion 1*a*. The top plate of the cover 1 can be easily flexed downward at its center portion with a minimum external force. Therefore, the projection preferably is located directly below the center portion of the thin-walled portion of the top plate of the cover 1. For this purpose, a U-shaped support 30 which has a center projection 9*f* can be provided, as illustrated in FIG. 10. The support 30 is located at the center of the base 3 in its longitudinal direction and bridges the spring arms 5 and 5', so that the support 30 is positioned directly below the center of the top plate of the cover 1.

Instead of a support 30, a barrier 33 can be provided on which there is a projection 9*g* in the center as shown in FIG. 1. The barrier (or barriers) 33 is (or are) usually located between the spring arms 5 and between the spring arms 5' to prevent the spring arms from electrically interfering with each other. In FIG. 11, the numerals 35 and 36 designate coil bobbins and a coil, respectively.

In the embodiments shown in FIGS. 10 and 11, the thin-walled portion 1*a* is, of course, located at the center of the top plate of the cover 1, corresponding to the location of the projection 9*f* or 9*g*.

Figure 15:
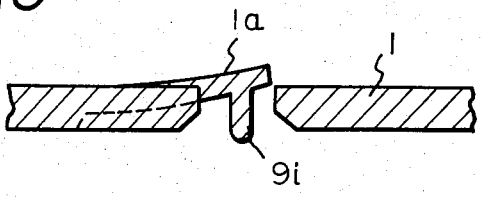
FIG. 15 is a view similar to FIG. 13 but shown in a different position.

Finally, FIGS. 12, 13, 14 and 15 show different embodiments in which the thin-walled portion is provided with a projection. In an embodiment of FIG. 12, the projection 9*h* is integral with the thin-walled portion 1*a* of the cover 1 and extends downward therefrom. Also in the embodiment illustrated in FIGS. 13–15, the projection 9*i* is provided on the thin-walled portion 1*a* of the cover 1. The thin-walled portion 1*a* has a special shape such as that of a key with a connecting piece 1*b*, so that even when the thin-walled portion 1*a* is broken, it can be partially connected at the connecting piece 1*b* to the cover 1 without being completely separated from the latter, as illustrated in FIG. 15. Therefore, no broken piece of thin-walled portion drops in the relay, in the embodiments shown in FIGS. 13–15.

As is apparent from the above description, according to the present invention, since a completely sealed relay can be provided, it can be easily dip-washed. In addition, after dip-washing, an opening through which organic gas can escape can be easily formed by breaking the thin-walled portion on the cover.

What is claimed is:

1. A relay adapted to be mounted on a printed circuit board, comprising a relay body and a relay cover which is mounted in a fluid-tight fashion to the relay body, said relay cover being provided with a thin-walled portion which can be broken to define an opening therein, and said relay body is provided with a projection which is located directly below said thin-walled portion and which is adapted to break the latter upon contact therewith.

2. A relay according to claim 1, wherein said relay body comprises a base, at least one contact spring mold located on the base, and means located on the contact spring mold for securing the same to the base, said projection being provided on said securing means.

3. A relay according to claim 2, wherein said securing means comprises a keep plate adapted to hold the contact spring mold on the base.

4. A relay according to claim 2, wherein said securing means comprises a metal band which surrounds the contact spring mold to hold the same on the base.

5. A relay according to claim 1, wherein said relay body comprises a base, and at least one contact spring mold which is located on and secured to the base, said projection being provided on the contact spring mold.

6. A relay according to claim 1, wherein said relay body comprises spring arms having movable contacts which can be alternately connected to fixed contacts arranged in the relay body, said projection being provided on one of said spring arms.

7. A relay according to claim 1, wherein said thin-walled portion is located at the center of the relay cover.

8. A relay according to claim 7, wherein said body includes a support, said projection being monted on said support and located below said center thin-walled portion.

9. A relay according to claim 7, wherein said relay body comprises spring arms having movable contacts which can be alternately connected to fixed contacts arranged in the relay body, and at least one barrier located between the spring arms for preventing the spring arms from interfering with each other, said projection being provided on said barrier.

10. A relay according to claim 2, 3, 4, 5, 6, 7, 9, 8, or 1 wherein said thin-walled portion has a connecting piece which remains connected to the relay cover when the thin-walled portion is broken.

* * * * *